US008182113B2

(12) United States Patent
Sharpe

(10) Patent No.: US 8,182,113 B2
(45) Date of Patent: May 22, 2012

(54) ACCESSORY AND METHOD FOR A MAILBOX

(76) Inventor: George Sharpe, Pompton Plains, NJ (US)

( * ) Notice: Subject to any disclaimer, the term of this patent is extended or adjusted under 35 U.S.C. 154(b) by 435 days.

(21) Appl. No.: 12/237,510

(22) Filed: Sep. 25, 2008

(65) Prior Publication Data

US 2010/0073919 A1 Mar. 25, 2010

(51) Int. Cl.
*F21V 33/00* (2006.01)

(52) U.S. Cl. ..... 362/253; 362/812; 362/311.1; 40/564; 40/575; 232/45

(58) Field of Classification Search ..... 362/806, 362/812, 311.1, 253; 40/564, 575, 566; 232/38, 232/17, 45, 46
See application file for complete search history.

(56) References Cited

U.S. PATENT DOCUMENTS

| | | | | |
|---|---|---|---|---|
| 5,460,325 | A | 10/1995 | Surman | |
| 5,522,540 | A | 6/1996 | Surman | |
| 5,649,378 | A | 7/1997 | Roesser, Jr. et al. | |
| 6,299,325 | B1 | 10/2001 | Cathel | |
| 6,629,766 | B2 | 10/2003 | Cathel | |
| 6,708,876 | B1 * | 3/2004 | Shirah | 232/38 |
| 6,719,193 | B2 | 4/2004 | Katulka | |
| 6,964,366 | B2 * | 11/2005 | Peng et al. | 232/38 |
| 2006/0118609 | A1 | 6/2006 | Iannello | |
| 2007/0006496 | A1 | 1/2007 | Jones et al. | |

* cited by examiner

*Primary Examiner* — Ali Alavi
(74) *Attorney, Agent, or Firm* — Thomas L. Adams

(57) ABSTRACT

An accessory that can be mounted over a mailbox has a base with a pair of sidewalls that are spaced to straddle the mailbox. A frame assembly mounted on at least one of the sidewalls has one or more indicia bearing members removably attached thereto. These indicia bearing members are installed and arranged to supply address information. A light mounted at the frame assembly is powered by a power supply that has a solar powered charger for charging a battery in order to illuminate the indicia bearing members at night.

15 Claims, 3 Drawing Sheets

ACCESSORY AND METHOD FOR A MAILBOX

BACKGROUND OF THE INVENTION

1. Field of the Invention

The present invention relates to accessories and methods for marking mailboxes, and in particular, to equipment and techniques for illuminating the markings.

2. Description of Related Art

People use house numbers to identify their house from others on the street. Identifying a house is important for visitors and especially important should emergency personnel (police, firefighters, etc.) need to quickly find the house. People will place house numbers on the side of the building facing the street for maximum visibility. For his visibility at night, house current may be used to power a light to illuminate the house number.

Often mailboxes are detached from the house and mounted on a post near the curb or street. Then, the mail delivery person need not walk from the street to the front of the house, which can be a long walk, especially in rural areas. The post supporting the curbside mailbox is typically an upright post with a horizontal cantilevered arm. The mailbox is attached by driving screws through a lower apron of the mailbox into the cantilevered arm. This type of mailbox is usually a box with a cylindrical roof integral with a pair of parallel sidewalls. A hinged door in the front of the mailbox can be opened to deliver/retrieve mail.

Marking a house number on such a mailbox is especially helpful since the number is very close to passerbys, who need not search the front of a house to find an often obscure house number. On the other hand, illuminating the house number marked on such a mailbox is difficult because of its distance from the house where electrical power is available. One can run power cables from the house to the curbside mailbox but such an installation is expensive, requires specialized skills and materials, and can be pose safety hazards.

Also, even if one is willing to route electrical power from the house, one must modify the mailbox to include a light or replace the mailbox with one originally manufactured with a light.

See also U.S. Pat. Nos. 5,5460,325; 5,522,540; 5,649,378; 6,299,325; 6,629,766; 6,708,876; 6,719,193; and 6,964,366; as well as US Patent Application Publication Nos. 2006/0118609 and 2007/0006496

SUMMARY OF THE INVENTION

In accordance with the illustrative embodiments demonstrating features and advantages of the present invention, there is provided an accessory for a mailbox. The accessory has a base with a pair of sidewalls that are spaced to straddle the mailbox. Also included is a frame assembly mounted on at least one of the sidewalls. The accessory also has one or more indicia bearing members removably attached to the frame assembly. Also included is a light mounted at the frame assembly. The accessory has also a power supply coupled to the light and having a solar powered charger.

In accordance with another aspect of the invention a method for displaying indicia on a mailbox is provided. The method employs an arched base with an opposing pair of dependent sidewalls. The method includes several steps, performed in any order. One step is installing on at least one of the sidewalls one or more indicia bearing members arranged to supply address information. Another step is lowering the base over the mailbox with the sidewalls straddling the mailbox. The method also includes the step of storing solar energy to illuminate the indicia bearing members at night.

In accordance with yet another aspect of the invention there is provided an accessory for a mailbox. The accessory has a base including a curved arch having (a) a dependent pair of sidewalls and (b) an upper pedestal with a battery compartment. The curved arch is adapted to rest atop the mailbox. The pair of sidewalls have lower portions that are parallel and adapted to straddle the mailbox. The sidewalls each have a plurality of peripheral fastening slots. The accessory also has a spaced pair of frames mounted on the pair of sidewalls. Also included is a pair of display boards slidably mounted in different corresponding ones of the pair of frames. The accessory also has a plurality of translucent indicia bearing panels attached to the pair of display boards. Also included is a plurality of lights mounted at the pair of frames. The accessory also has a power supply coupled to the plurality of lights and having (a) a pair of circuit boards mounted aloft in the pair of frames for supporting the plurality of lights, (b) a solar powered charger, (c) a light sensitive switch, (d) a voltage regulator, and (e) a solar cell mounted upon the pedestal. The solar cell is hingedly mounted on the pedestal in order to swing away and allow access to the battery compartment.

By employing apparatus and methods of the foregoing type, opportunities for illuminating indicia on a mailbox are greatly enhanced. In a disclosed embodiment a saddle-shaped base is designed to fit over an existing mailbox and be fastened in place using mounting holes or slots provided along the bottom edge of the base. Accordingly, an existing mailbox can be retrofitted and need not be replaced.

In this disclosed embodiment frames mounted on opposite sides of the base have slots for receiving display boards that carry a series of panels bearing numbers, letters or other indicia indicating the house number or other information associated with the owner's address.

Lights such as LEDs can be mounted in a cavity in the frame behind the display board to backlight the indicia bearing panels. The LEDs can be mounted on a horizontal, printed circuit board mounted at the ceiling of the cavity.

In this embodiment, the LEDs are normally powered by a rechargeable battery mounted in a compartment inside a pedestal at the top of the base. The batteries can be recharged by a solar panel that is part of a lid that is hinged to the pedestal. The disclosed lid can be lifted to gain access to the battery compartment. In any event, the batteries can be charged by the solar panel during daylight, while at night a light sensitive switch can operate to deliver battery power to illuminate the LEDs.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

the

Figure 1:
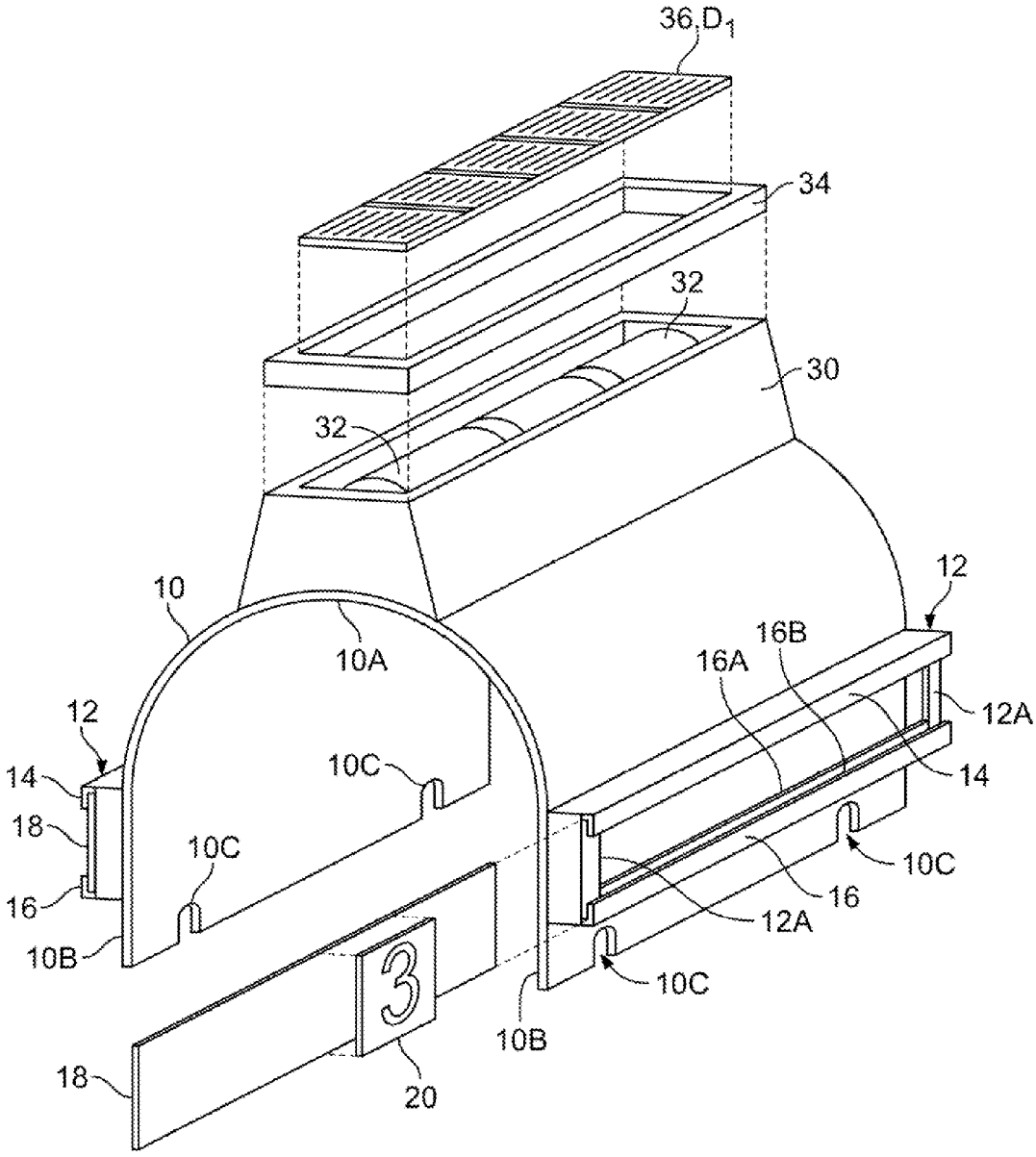
FIG. 1 is an exploded, perspective view of an accessory in accordance with principles of the present invention.
Figure 2:
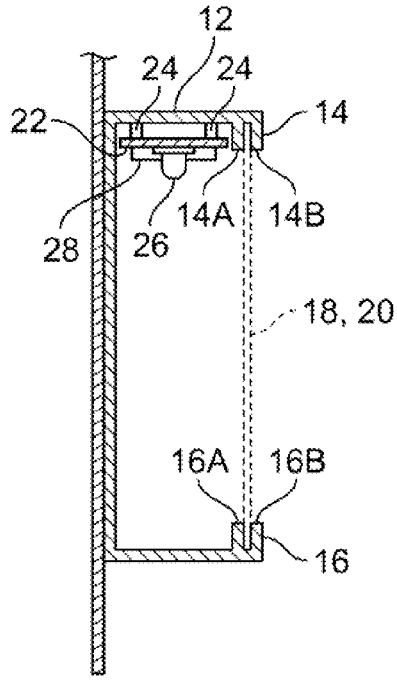
Figure 3:
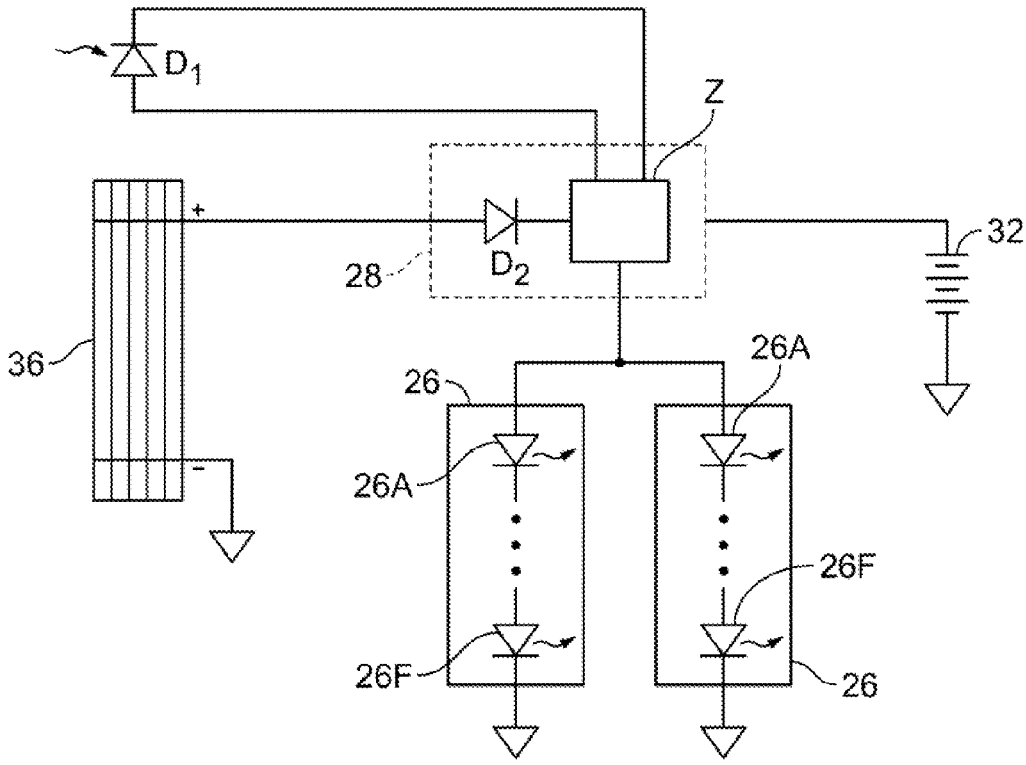
Figure 4:
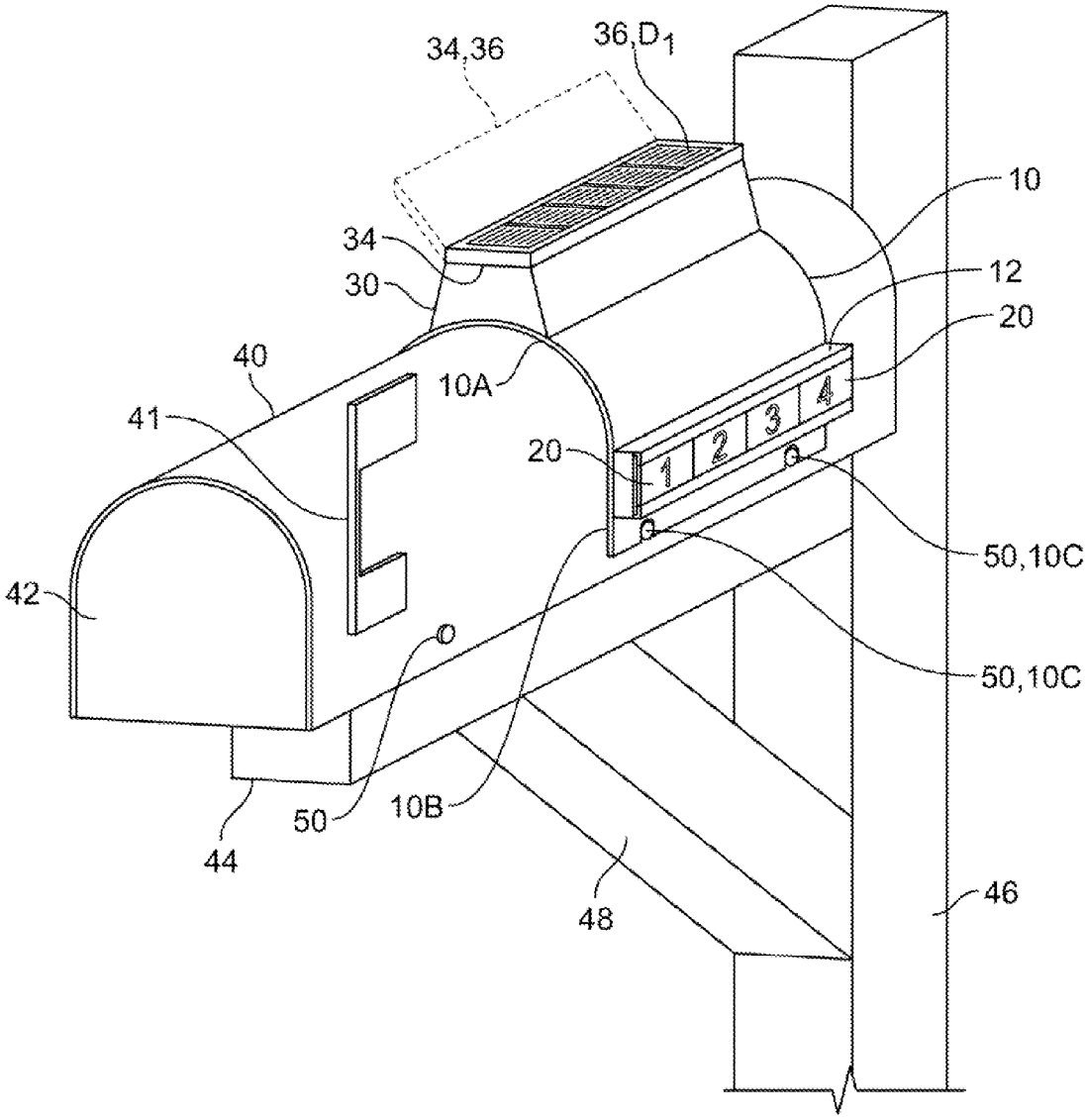

FIG. 2 is a cross-sectional view of a portion of the accessory of FIG. 1, showing details of a frame assembly;

FIG. 3 is a schematic diagram of a power supply for illuminating the lights of FIG. 2; and FIG. 4 is a perspective view of the accessory of FIG. 1 installed on a mailbox.

DETAILED DESCRIPTION OF THE PREFERRED EMBODIMENTS

Referring to FIGS. 1 and 2, the illustrated mailbox accessory has a base 10 with a curved arch 10A integral with a pair of sidewalls 108 whose lower portions are parallel and notched with a pair of peripheral fastening slots 10C. A frame assembly is shown as a spaced pair of frames 12 mounted on sidewalls 10B. Each of the frames 12 has the form of a five sided rectangular box that is open in front, but includes in front lateral flanges 12A, as well as upper channel 14 and lower channel 16.

In FIG. 2, a vertical cross-section is taken through the middle of frame 12, revealing that channel 14 is composed of two short, parallel walls 14A and 14B, while channel 16 is composed of two short, parallel walls 16A and 16B. Channels 14 and 16 are designed to slidably receive display boards 18 shown in perspective in FIG. 1 and in phantom in FIG. 2. In this embodiment board 18 can be either translucent or transparent.

Board 18 is designed to receive one or more indicia-bearing members, shown as translucent panel 20 marked with a character. Alternatively, panel 20 may be a stencil-like marker. A number of panels similar to panel 20 will be composed side-by-side on board 18 to indicate a house number or other address information.

Panel 20 can be secured to board 18 by adhesive. Alternatively board 18 can be manufactured with recesses designed to receive panel 20. In some embodiments board 18 may be a sleeve into which panel 20 may be slid. Furthermore in some embodiments panel 20 can be mounted behind board 18, which will in this case be transparent. In any event it is desirable to secure panel 20 to board 18 before sliding them together into channels 14 and 16.

Printed circuit board 22 is mounted to the ceiling of frame 12 by standoffs 24. Mounted on circuit board 22 are a series of six lights, one such light shown herein as LED 26. LEDs 26 shine into the cavity of frame 12 and backlight display board 18 and indicia-bearing panels 20. Other circuit components 28 on printed circuit board 22 are described further hereinafter.

Projecting upwardly from the curved arch 10A of base 10 is a hollow pedestal 30, which is open on top and contains three rechargeable batteries 32 in the pedestal's battery compartment. A four sided frame 34 is hinged to the rim of pedestal 30 and supports a solar panel 36 having a plurality of solar cells. Solar panel 36 incorporates a photodiode D1, which acts as a light sensitive switch in a manner of the described further hereinafter.

Referring to FIG. 3, photodiode D1 is shown connected to switched regulator circuit Z, which is part of a power supply. The cathode of blocking diode D2 is connected to circuit Z. The anode of diode D2 is connected to the positive terminal of previously mentioned solar panel 36, whose negative terminal is grounded. Panel 36 is part of a solar powered charger. Circuit Z is also connected to the positive terminal of previously mentioned, rechargeable batteries 32) whose negative terminal is grounded. Previously mentioned lights 26 are shown as two parallel arrays (one for the right and the other for the left) connected between circuit Z and ground. Each of the arrays 26 comprise six serially connected LEDs 26A-26F, which are connected anode to cathode, with the cathode of the last LED 26F grounded.

Arrays 26 are mounted on the two previously mentioned printed circuit boards (boards 22 in the two frames 12 of FIGS. 1 and 2). Circuitry 28 (diode D2 and circuit 2) can be mounted on either one of these printed circuit boards or on a separate circuit board dedicated to this purpose. As previously mentioned, batteries 32 are mounted in the pedestal (pedestal 30 of FIG. 1) and elements 36 and D1 are mounted in the hinged frame (frame 34, also of FIG. 1).

Referring to FIG. 4, a conventional mailbox 40 is shown with a semicylindrical roof integral with a pair of parallel sidewalls, one of them fitted with the usual swinging flag 41. The mailbox is closed in front with a door of 42. The underside of mailbox 40 is recessed and is shown straddling cantilevered beam 44, which is mounted on upright post 46 and reinforced with slanted brace 48. The lower edges of mailbox 40 are shown fastened to beam 44 with fasteners 50, for examples screws or nails. Two of the fasteners 50 are inserted through the previously mentioned slots 10C to secure base 10 onto mailbox 40. Base 10 is shaped to conform closely to the outline of mailbox 40 and is positioned with solar panel 36 facing up.

Frame 12 (on both sides) is fitted with four markers 20 indicating a four digit house number, although it will be appreciated that in some embodiments the displayed house number may be a different number of digits.

To facilitate an understanding of the principles associated with the foregoing apparatus, its operation will be briefly described During daylight sunlight will stimulate solar panel 36 and photodiode D1 (FIG. 3). Consequently, panel 36 will produce a current that forward biases diode D2 and in response, switched regulator circuit Z will apply a charging current to batteries 32. Because it is also stimulated, photodiode D2 becomes conductive and sends a signal to circuit Z that prevents current from flowing through LED arrays 26.

When night falls solar panel 36 is no longer stimulated and will produce essentially no current or voltage. Blocking diode D2 will prevent reverse current from flowing through panel 36. Because it is no longer stimulated, photodiode D1 sends a signal to switched regulator circuit Z, which now allows a discharging current to flow from batteries 32 into LED arrays 26.

With LEDs 26 now energized, white light will be emitted from the LEDs into the interior of frame 12 (FIG. 2). Consequently, display board 18 and translucent panels 20 (FIGS. 1 and 4) will be backlighted so that passerbys can easily see the house number at night.

It is appreciated that various modifications may be implemented with respect to the above described embodiments. Base 10 can be formed of metal, plastic, or other materials and can be formed by molding, extrusion, stamping, dies etc. In some embodiments base 10 can be made a flexible material that can be bent around a mailbox in order to conform with mailboxes having different shapes. Also, in some embodiments the sidewalls of the base can hang lower than the mailbox itself to provide a larger area for accommodating larger house numbers. Instead of using lower peripheral fasteners, some embodiments may use adhesives or other means to fasten the base to the mailbox. While backlighting LEDs are disclosed, other embodiments may use front lighting and the lights may be incandescent bulbs, electroluminescent panels, etc. Alternatively, a series of LEDs may be laid out on individual panels to form characters of a house number. In some embodiments batteries may be mounted inside the frames holding the house numbers. In addition, solar panels may be mounted atop the frames holding the house numbers, or directly atop the base. Furthermore, the light sensitive photodiode may be a phototransistor, photocell, or other photosensitive device and may be mounted in another location, not necessarily adjacent to the solar panel. Also the size, shape, proportions, and other dimensions of the mailbox accessory can be altered depending upon the size and shape of the target mailbox, the desired strength and capacity of the accessory, as well as other environmental, physical, structural, or aesthetic considerations.

Obviously, many modifications and variations of the present invention are possible in light of the above teachings. It is therefore to be understood that within the scope of the appended claims, the invention may be practiced otherwise than as specifically described.

The invention claimed is:

1. An accessory for a mailbox comprising:

a base with a pair of sidewalls that are spaced to straddle said mailbox;

a frame assembly mounted on at least one of said sidewalls;

one or more indicia bearing members removably attached to said frame assembly;

a light mounted at said frame assembly; and a power supply coupled to said light and having a solar powered charger, said frame assembly comprising a display board for holding said one or more indicia bearing members, said display board being slidably removable together with said indicia bearing members.

2. An accessory according to claim 1 wherein said pair of sidewalls have lower portions that are parallel and adapted to straddle said mailbox.

3. An accessory according to claim 2 wherein said base has a curved arch spanning said pair of sidewalls, said curved arch being adapted to rest atop said mailbox.

4. An accessory according to claim 3 wherein said sidewall each have a plurality of peripheral fastening slots.

5. An accessory according to claim 1 wherein said frame assembly has a spaced pair of frames mounted on said pair of sidewalls, said one or more indicia bearing members being a plurality of markers mounted in said pair of frames.

6. An accessory according to claim 1 wherein said power supply includes a solar cell, said accessory comprising:

a pedestal mounted atop said base, said solar cell being mounted upon said pedestal.

7. An accessory according to claim 6 wherein said pedestal has a battery compartment.

8. An accessory according to claim 1 wherein said one or more indicia bearing members comprise:

a plurality of translucent panels.

9. An accessory according to claim 1 wherein said frame assembly has a cavity behind said one or more indicia bearing members.

10. An accessory according to claim 1 wherein said power supply comprises:

a light sensitive switch; and a voltage regulator.

11. An accessory for a mailbox comprising:

a base with a pair of sidewalls that are spaced to straddle said mailbox;

a frame assembly mounted on at least one of said sidewalls;

one or more indicia bearing members removably attached to said frame assembly;

a light mounted at said frame assembly;

a power supply coupled to said light and having a solar powered charger including a solar cell; and a pedestal mounted atop said base and having a battery compartment, said solar cell being mounted upon said pedestal, said solar cell being hingedly mounted upon said pedestal in order to swing away and allow access to said battery compartment.

12. An accessory for a mailbox comprising:

a base with a pair of sidewalls that are spaced to straddle said mailbox;

a frame assembly mounted on at least one of said sidewalls;

one or more indicia bearing members removably attached to said frame assembly, said frame assembly having a cavity behind said one or more indicia bearing members;

a light mounted at said frame assembly; and a power supply coupled to said light and having a solar powered charger, said power supply comprising a circuit board mounted in said cavity, said light including a plurality of light emitting diodes mounted on said circuit board.

13. An accessory according to claim 12 wherein said cavity has a ceiling, said circuit board being mounted at said ceiling.

14. An accessory according to claim 12 wherein said power supply comprises:

a light sensitive switch; and a voltage regulator.

15. An accessory for a mailbox comprising:

a base including a curved arch having (a) a dependent pair of sidewalls and (b) an upper pedestal with a battery compartment, said curved arch being adapted to rest atop said mailbox, said pair of sidewalls having lower portions that are parallel and adapted to straddle said mailbox, said sidewalls each having a plurality of peripheral fastening slots;

a spaced pair of frames mounted on said pair of sidewalls;

a pair of display boards slidably mounted in different corresponding ones of said pair of frames;

a plurality of translucent indicia bearing panels attached to said pair of display boards;

a plurality of lights mounted at said pair of frames; and a power supply coupled to said plurality of lights and having (a) a pair of circuit boards mounted aloft in said pair of frames for supporting said plurality of lights, (b) a solar powered charger, (c) a light sensitive switch, (d) a voltage regulator, and (e) a solar cell mounted upon said pedestal, said solar cell being hingedly mounted on said pedestal in order to swing away and allow access to said battery compartment.

* * * * *